United States Patent [19]

Orenstein

[11] 4,272,914

[45] Jun. 16, 1981

[54] ROCKET CAR

[76] Inventor: Henry Orenstein, Claridge House, Verona, N.J. 07044

[21] Appl. No.: 6,687

[22] Filed: Jan. 26, 1979

[51] Int. Cl.[3] ..... A63H 29/20; A63H 17/04; A63H 11/10; A63H 13/16

[52] U.S. Cl. ..... 46/209; 46/211; 46/202; 46/145

[58] Field of Search ..... 46/202, 209, 98, 104, 46/112, 266, 265, 264, 252, 262, 145, 211

[56] References Cited

U.S. PATENT DOCUMENTS

| | | | |
|---|---|---|---|
| 2,735,221 | 2/1956 | Fields | 46/202 |
| 3,024,566 | 3/1962 | Licitis | 46/219 |
| 3,151,866 | 10/1964 | Glass et al. | 46/264 |
| 3,383,794 | 5/1968 | Ruth | 46/252 |
| 3,540,152 | 11/1970 | Beny et al. | 46/219 |
| 3,587,191 | 6/1971 | Cooper | 46/148 |
| 3,774,586 | 11/1973 | Saito | 46/219 |
| 3,869,825 | 3/1975 | Heberlein | 46/219 |
| 3,968,593 | 7/1976 | Lin | 46/209 |
| 3,984,939 | 10/1976 | Wolgamot et al. | 46/209 |

*Primary Examiner*—Gene Mancene
*Assistant Examiner*—Michael J. Foycik, Jr.
*Attorney, Agent, or Firm*—George E. Kersey

[57] ABSTRACT

A toy vehicle which includes a mechanism for firing projectiles such as rockets. After the vehicle has been operative for a prescribed period of time the rocket is fired. Simultaneously, or after a coordinated delay, the vehicle is caused to undergo a change in operation, such as a change in speed such that the impression is given that the speed change is caused by the firing of the rocket.

8 Claims, 8 Drawing Figures

FIG. 3A
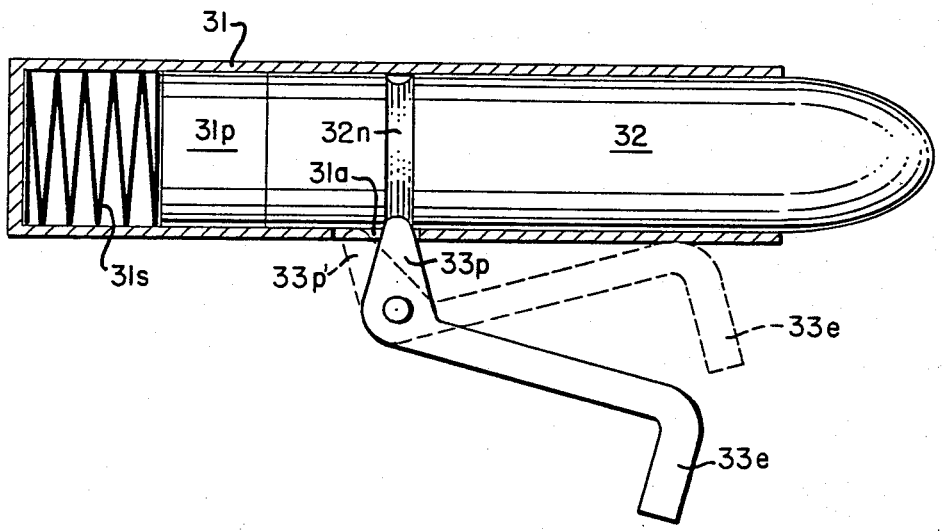
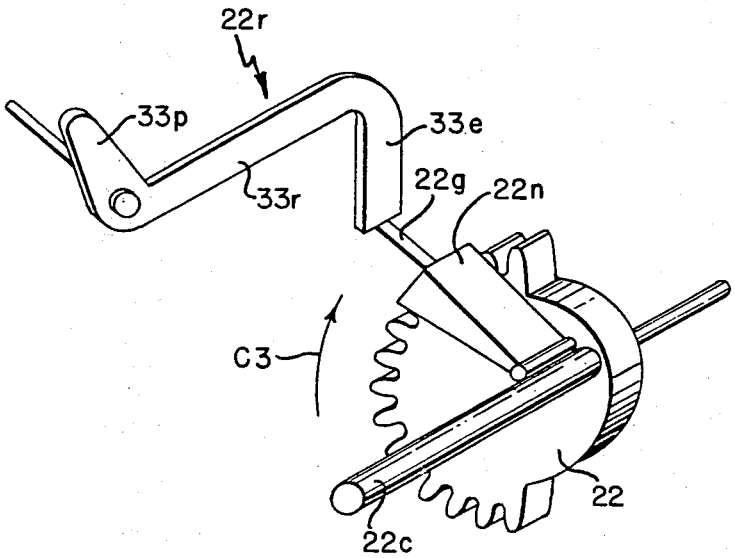
FIG. 3B

FIG. 4A
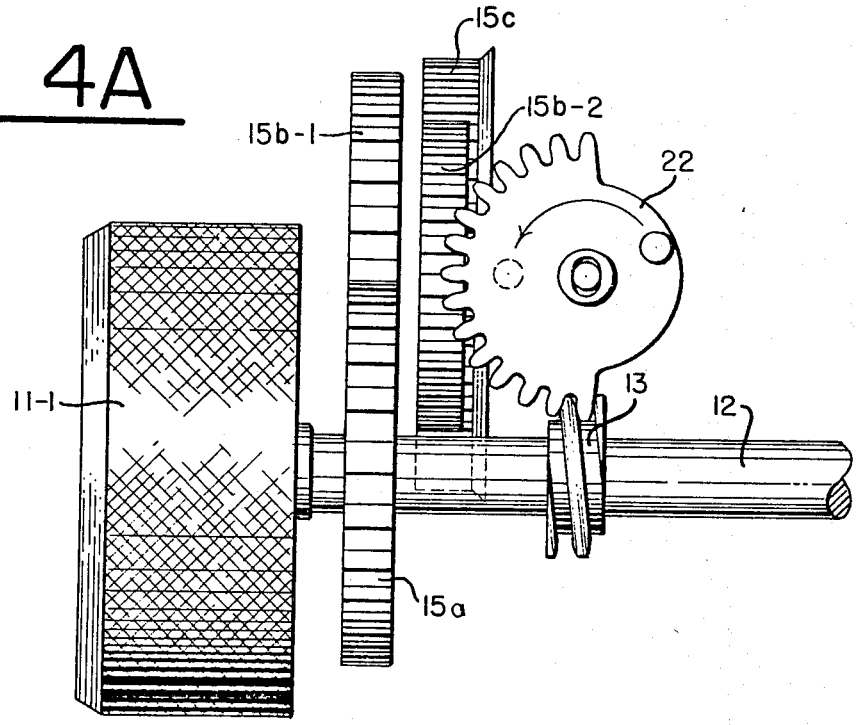
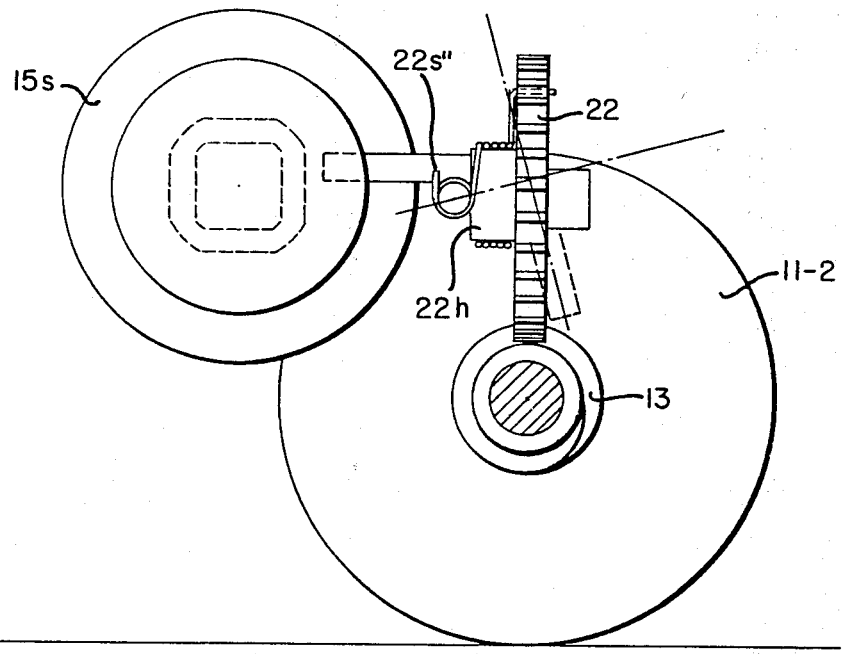
FIG. 4B

ROCKET CAR

BACKGROUND OF THE INVENTION

This invention relates to toy vehicles, and more particularly to toy vehicles which simulate rocket assisted propulsion.

In vehicles with rocket assisted propulsion, a forward impulse is imparted by the firing of a rocket. This results from the well known law of physics by which each action is accompanied by an equal and opposite reaction. Thus, the reaction to the firing of a rocket is the production of an impulsive forch which is able to propel a vehicle in the opposite direction.

Rocket propulsion can be engaging and of considerable interest to a youngster. It can be educational as well. Unfortunately, actual rockets are much too dangerous, expensive and complex to be suitable as toys.

Accordingly, it is an object of the invention to achieve the effect of rocket propulsion without attendant chemical and mechanical dangers that accompany actual rocket propulsion.

Still another object of the invention is to achieve the appearance of rocket propulsion not only without using chemical propellants but also without any internally contained source of energy, such as a battery.

A further object of the invention is to achieve the effect of rocket propulsion in a toy vehicle in which the entire motive power is supplied by the user.

SUMMARY OF THE INVENTION

In accomplishing the foregoing and related objects, the invention provides a toy vehicle with a timing mechanism that provides simulated rocket propulsion at the end of a prescribed time interval.

In accordance with one aspect of the invention, the timing mechanism is disengaged from the motive portion of the vehicle during the initial energization period. This is followed by release of the vehicle and engagement of the timing mechanism which then operates for a prescribed interval to bring about the desired simulative effect. In particular, the operating of the timing mechanism brings about the release of a rocket which can be coordinated with a change in the operation of the vehicle, such as a change in speed of the vehicle.

In accordance with a particular embodiment of the invention the power train of the toy vehicle is frictionally energized by reciprocating rotation motion which rotates the drive wheel of the vehicle and stores energy in a flywheel. When sufficient energy has been stored in the flywheel, the car is released, causing a control gear of the timing mechanism to engage a worm gear which is operated by the rear wheels. The control gear is then rotated to a position where a slider is moved into engagement with an auxiliary gear to change the speed condition of the vehicle, i.e., increase it, and simultaneously fire a rocket, giving the impression that the increase in speed is caused by the firing of the rocket.

DESCRIPTION OF THE DRAWINGS

Other aspects of the invention will become apparent after consideration of several illustrative embodiments taken in conjunction with the drawings in which:

FIG. 3A is a side view, partially in section, of the rocket mechanism for the car of FIG. 1A;

FIG. 3B is a partial perspective view showing the operation of the rocket mechanism by the control mechanism of FIG. 2A; and FIGS. 4A and 4B are alternative control mechanisms for the car of FIG. 1A.

DETAILED DESCRIPTION

Figures 1A, 1B:
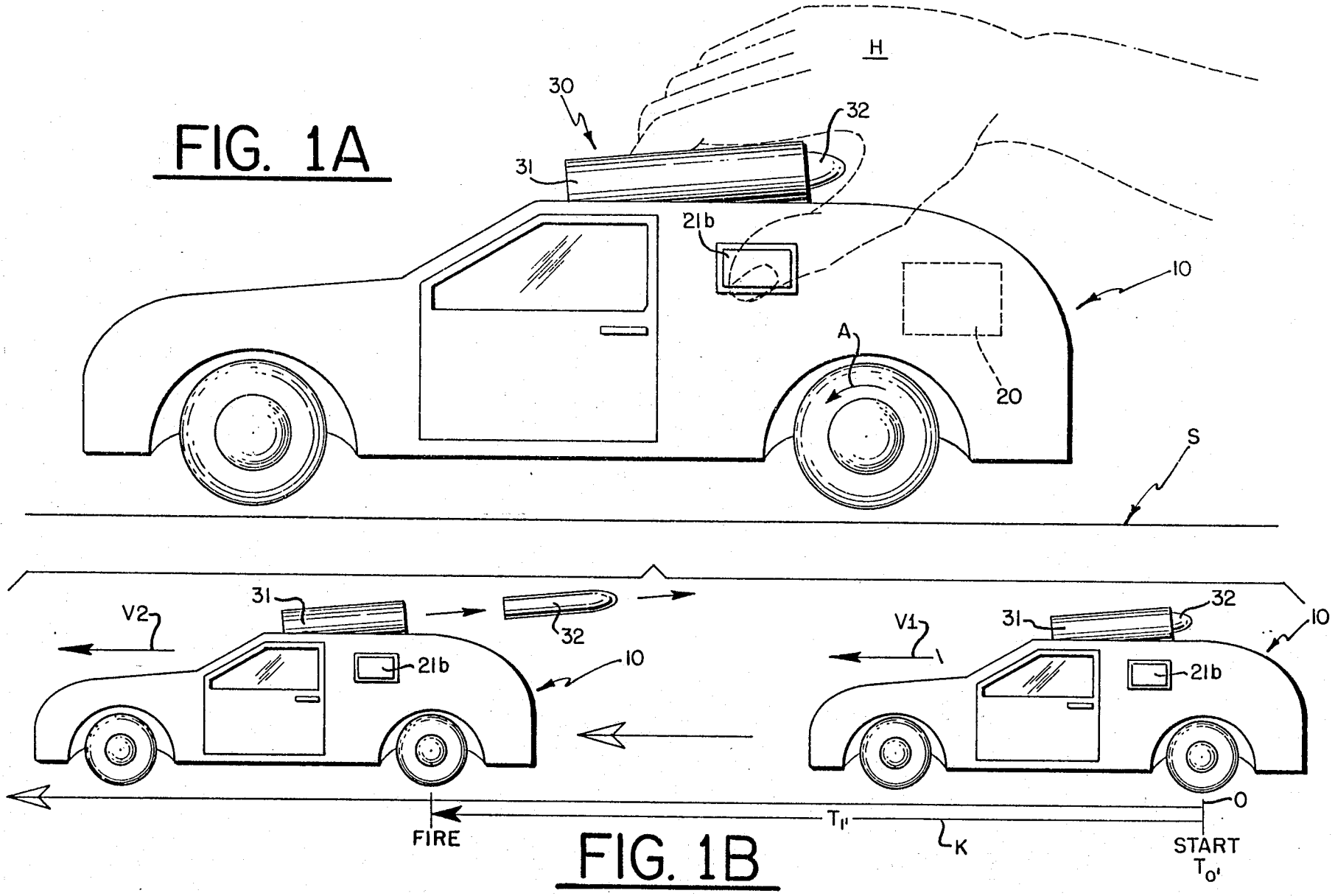
FIG. 1A is a side view of a "Rocket" car in accordance with the invention.
FIG. 1B is an illustration of the operation of the car of FIG. 1A with an accompanying timing diagram.

With reference to the drawings, a Rocket car 10 in accordance with the invention is shown in FIG. 1A grasped in the hand H of a user and being prepared for usage. By grasping the car 10 as shown, the hand H depresses button **21*b* of a control mechanism 20 to disengage the mechanism as described below. Simultaneously energy is stored in the car, illustratively by frictional "wind-up" action in which the rear wheels of the car are placed in sustained rotation indicated by the arrows A by being rolled against a surface S through reciprocating action of the hand H. It will be appreciated that motive power for the car 10 may come from other sources, such as a battery, but that the frictional energization of the car 10** indicated in FIG. 1A is particularly advantageous in producing a low cost toy that does not require expensive energization techniques.

In addition to frictional energization, the car 10 of FIG. 1A includes a rocket mechanism 30 which is illustratively formed by a rocket barrel 31 and a rocket projectile 32.

Once the car 10 has been sufficiently energized, it is released on the surface S, which may have any desired configuration, including curves, ramps, guides and the like but is shown as a plane for simplicity in FIG. 1A.

Release of the car 10 on the surface S permits the control button **21*b* to return to its operational position, allowing the control mechanism 20 to be activated as described in detail below. The car 10 then proceeds, as shown in FIG. 1B, from its starting or origination point 0, indicated in the accompanying time scale K at time $T_0$, along a prescribed course at its initial speed condition V1 until the elapse of a time $T_1$, at which the rocket projectile 32 is fired from the rocket barrel 31 on top of the car 10**.

The firing of the projectile 32 is coupled with a change in the driving mechanism of the car 10 which produces an increase in the speed of the car to V2 giving the impression that this results from the firing of the rocket projectile 32. It will be apparent that the firing of the projectile and the change in speed of the car need not occur simultaneously, for example producing the effect of a delayed or even independenc response.

Figure 2A:
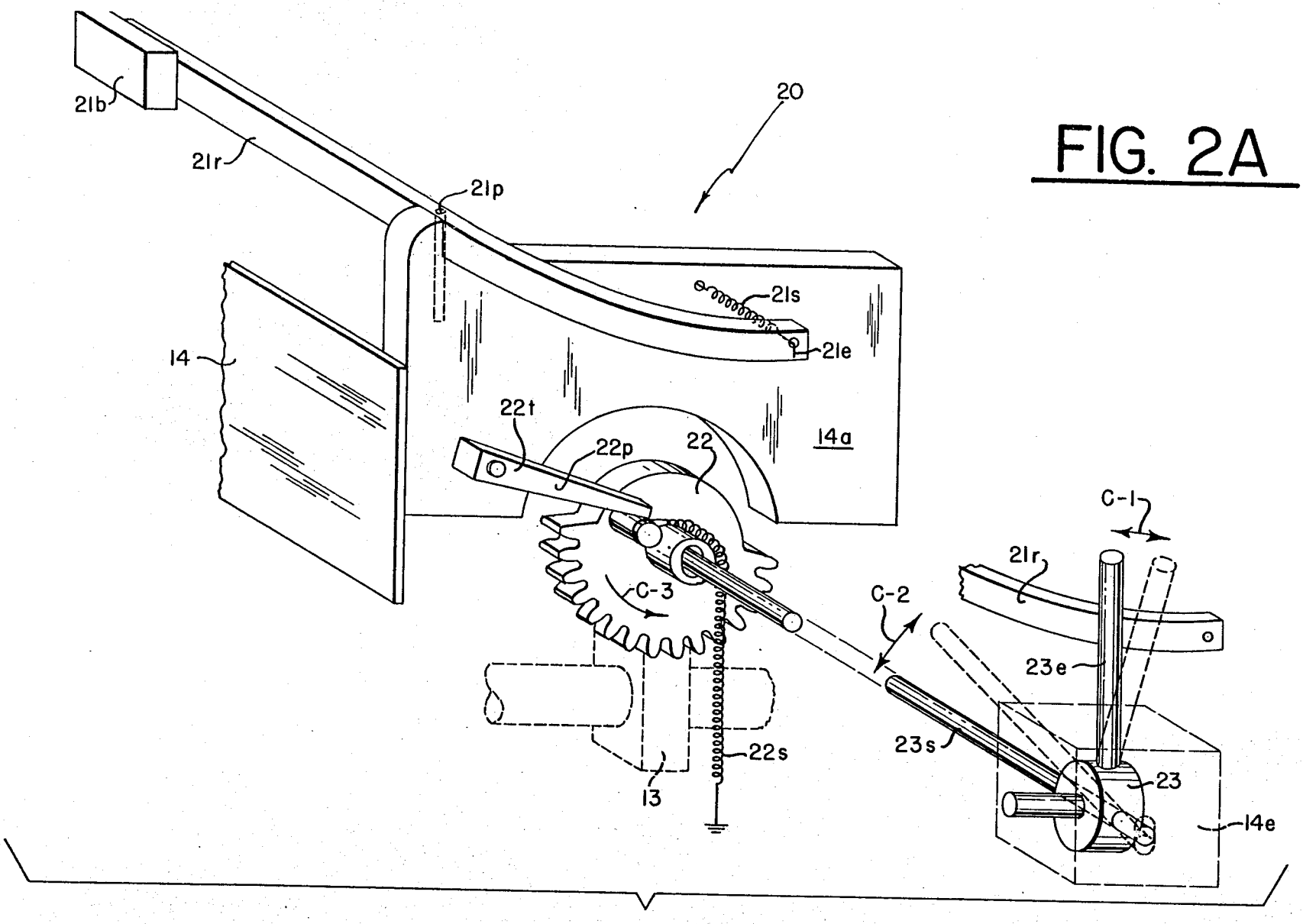
FIG. 2A is a partial perspective view of a control mechanism on the rear chassis of the car of FIG. 1A.
Figure 2B:
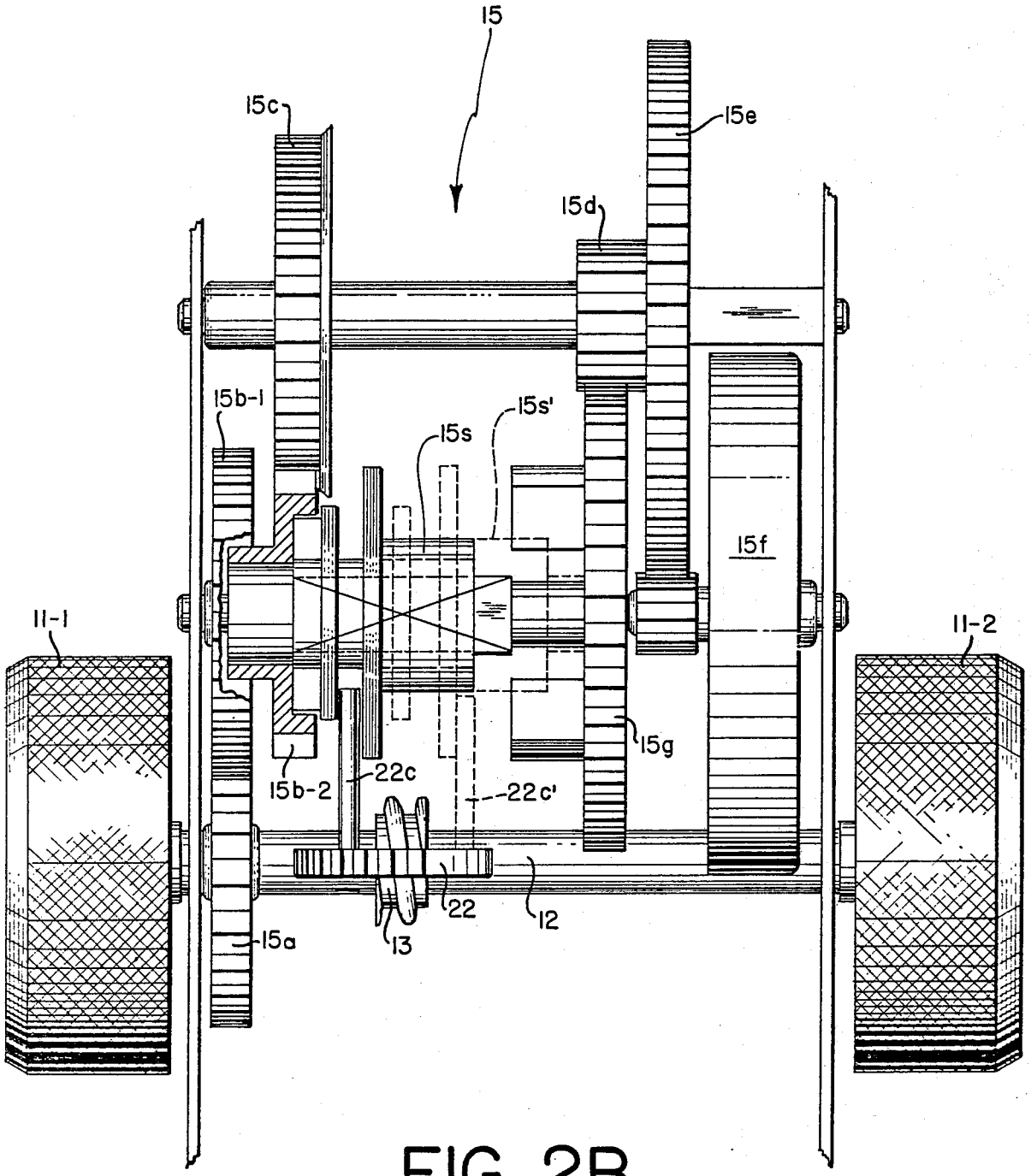
FIG. 2B is a plan view of a power train for the car of FIG. 1A controlled by the mechanism of FIG. 2A.

The control mechanism 20 on the rear of the chassis of car 10 is shown in FIG. 2A. As indicated in FIG. 2B, the rear wheels 11-1 and 11-2 of the car 10 are mounted on an axle 12 which includes a worm gear 13 that is able to act on a control gear 22. The control button **21*b* is at one end of a control lever 21*r* that is pivotally mounted at a position 21*p* on a partition 14*a* of the chassis 14 for the car 10. The control lever 21*r* is maintained in its initial position by a spring 21*s*. By virtue of the pivot mounting, the end 21*e* of the control lever is able to engage a spindle 23*e* of a rotor 23. The rotor 23 is pivotally mounted in an extension 14*e* of the chassis 14 and includes a shaft 23***s* that extends into a hub 22*h* of the control gear 22.

Because of the positioning of the shaft 23*s* in the hub 22*h* of the control gear 22, the depression of the control button 21*b*, for example by the hand H in FIG. 1A causes the rotor 23 to pivot in a clockwise direction indicated by the arrow C-1. This in turn raises the shaft 23*s* as indicated by the arrow C-2, to raise the control gear 22 and disengage it from the worm gear 13 on the shaft 12. As a result when the user depresses the control button 21*b* the control gear 22 is disengaged from the worm gear 13 and the frictional wind-up of the rear wheels 11-1 and 11-2 is not affected by the control mechanism, although the wind-up is transmitted to a flywheel (shown in FIG. 2B).

Once the control button 21*b* is released, the spring 21*s* draws the end 21*e* of the lever 21*r* away from engagement with the spindle 23*e*, so that the control gear 22 is pivoted, in the direction of the counterclockwise arrow C-2 of the shaft 23*s*, into engagement with the worm gear 13. As a result the control gear 22 begins to turn in the counterclockwise direction indicated by the arrow C-3 and control the power train 14 of FIG. 3B, as well as the rocket mechanism 30 of FIG. 3.

It is to be noted in connection with the control gear 22 it includes a pin which is initially in contact with an adjustable stop member 22*t*. When the control gear 22 is rotated in the counterclockwise direction indicated by the arrow C-3 to a position corresponding to the time $T_1$ of the timing diagram of FIG. 1B, the indicated control actions are effected: changing the speed of the car 10 from V1 to V2 and firing the rocket 22. It is to be noted that a spring 22*s* is wrapped around the hub 22*h* with one end secured to the pin and the other end secured to the frame 14. Consequently, at the completion of the operating cycle, i.e., when the rocket car has come to rest, depression of the control button 21*b* disengages the control gear 22 from the worm gear 14 and the spring 22*s* returns the control gear 22 to its starting position shown in FIG. 2A, ready for the next cycle of Rocket car operation.

The power train 15 for the rocket car 10 is shown in FIG. 2B. Initially, a slider gear 15*s* is in its phantom position 15*s*' with its hub in engagement with a main gear 15*g*. If the slider 15*s*' is out of engagement as a result of prior operation, depression of the control button 21*b* moves the slider to its phantom position by the arcuate movement of the control pin to its phantom position 22*c*' on the control gear 22 as that gear is reset to the position shown in FIG. 2A.

With the slider gear in its phantom position 15*s*', the frictional wind-up of the vehicle by the reciprocating contact of the rear wheels 11-1 and 11-2 with the surface S of FIG. 1A stores energy in the flywheel 15*f* through the gear train 15*a*, 15*b*-1, 15-2, 15*c*, 15*d* and 15*e*.

When the car 10 is released on the surface S (FIG. 1B), the car 10 moves at a speed V1 and the control gear 22 is operated by the worm gear 13, moving the control pin 22*c* in an arcuate path to the left in FIG. 2B until the slider gear 15*s* is disengaged, so that the operation is in neutral. Continued rotation of the control gear 22 then engages the high speed gear 15*b*-2, so that the energy stored in the flywheel 15*f* is able to move the rear wheels 11-1 and 11-2 at a faster rate, i.e. V2, than before.

In the particular tested embodiment of the invention, the slider gear 15*s* is in engagement with the low speed gear 15*g* for nine revolutions of the worm gear 13 while the slider travels 0.36 inches and the car moved 3.77 feet. The slider was next in neutral for one revolution of the worm gear 13 while moving 0.05 inches, and the car advanced 5 inches. The slider gear 15*s* finally moved 0.09 inches into complete engagement with the high speed gear 15*b*-2 over four additional revolutions. Simultaneously with the engagement of the slider gear 15*s* with the high speed gear 15*b*-2 there is firing of the rocket 32 as described below.

A perspective view of the control gear 22 of FIG. 2A from the front is set forth in FIG. 3B. In addition to the control pin 22*c* that moves the slider 15*s* into engagement with the auxiliary gear 15*b*-2, there is a projection 22*n* with a prong 22*g* to fire the rocket mechanism.

In particular when the prong 22*g* moves into contact with an extension 33*e* of a hingeably mounted lever 33*r*, subsequent rotation trips the lever and releases the rocket 32.

This is because, as shown in FIG. 3A, the end of the lever 33*r* opposite the extension 33*e* has a protuberance 33*p* which engages a notch 32*n* in the side of the projectile 32 through an aperture 31*a* in the barrel 31. The barrel also includes a spring 31*s* and a piston 31*p* which is depressed when the rocket 32 is inserted into the barrel. In particular the projectile 32 is pushed into the barrel 31 until the channel 32*n* is over the lever aperture 31*a*. At that point the firing lever 33*r* is able to pivot downwardly because of the torque effect of the extension 33*e*, causing the protuberance 33*p* to enter the channel 32*n* and thus hold the projectile 32 in place.

However, when the control gear 22 rotates to the position shown in FIG. 3B where the prong extension 22*g* is in contact with the pendant extension 33*e* of the lever, further rotation causes the lever 33*r* to pivot and move the lever projection 33*p* out of the channel 32*n*, allowing the projectile 32 to be fired by the spring loaded piston 31*p*.

An alternative arrangement for the control gear 22 is shown in FIGS. 4A and 4B, with an alternative spring 22*s*'' having one end fixed in the gear 22, then encircling the hub of the gear and having the other end fixed to a frame mounted pin. In addition the gear 22 of FIGS. 4A and 4B is pivoted downwardly, as indicate for disengagement from the worm gear 13.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. A toy device comprising a chassis with a shaft connected thereto, an energy source, means for connecting said energy source to drive said shaft at a first velocity, and means responsive to the rotation of said shaft for connecting said energy source to drive said shaft at a second velocity, greater than the first, and for operating an auxiliary device; wherein said energy source is a flywheel, the first mentioned connecting means is a gear train, and the second mentioned connecting means is a slider operated by the rotation of said shaft.

2. A toy device in accordance with claim 1 wherein the slider is operated by a control gear which is driven by said shaft.

3. A toy device in accordance with claim 1 wherein said control gear is manually releasable from contact with said shaft, thereby to permit the frictional energization of said flywheel.

4. A toy vehicle as defined in claim 1 wherein said shaft is an axle with drive wheels connected thereto, said flywheel energy source is frictionally engageable by said drive wheels, said slider is in engagement with a low speed drive gear, and the gear train connecting means includes a high speed drive gear which is activated by the movement of said slider into engagement therewith.

5. A toy vehicle as defined in claim 4 wherein said slider is disconnected from said low speed drive gear and connected to said high speed drive gear by the rotation of a control gear driven by said axle.

6. A toy device in accordance with claim 3 wherein said control gear includes means for operating said auxiliary device.

7. A toy device in accordance with claim 6 wherein said control gear operates said auxiliary device simultaneously with the connection of said energy source to drive said shaft.

8. A rocket firing toy vehicle in accordance with claim 5 wherein said auxiliary device is a spring loaded rocket which is released by the rotation of said control gear.

* * * * *